US006394865B1

(12) United States Patent
Arzadon

(10) Patent No.: US 6,394,865 B1
(45) Date of Patent: May 28, 2002

(54) SURFBOARD FIN COVER

(76) Inventor: Robert Anthony Arzadon, 8209 - 124th Ave. NE., Kirkland, WA (US) 98033

( * ) Notice: Subject to any disclaimer, the term of this patent is extended or adjusted under 35 U.S.C. 154(b) by 0 days.

(21) Appl. No.: 09/925,056

(22) Filed: Aug. 8, 2001

(51) Int. Cl.[7] ..... B63B 1/00
(52) U.S. Cl. ..... 441/79
(58) Field of Search ..... 441/74, 79; 114/361; 150/154, 166; 440/71; 30/162, 163; D21/778, 772

(56) References Cited

U.S. PATENT DOCUMENTS 3,374,495 A * 3/1968 Joyce ..... 441/74
4,586,451 A 5/1986 Mori
4,792,316 A * 12/1988 Skedeleski et al. ..... 441/74
4,830,403 A * 5/1989 Ohmori ..... 280/815
5,069,406 A * 12/1991 Colyer et al. ..... 248/156
5,147,235 A * 9/1992 Bamburak et al. ..... 441/79
5,174,220 A 12/1992 Skedeleski et al.
5,242,322 A * 9/1993 Chellemi et al. ..... 441/79
D341,643 S * 11/1993 Schmidt ..... D21/230
5,310,221 A * 5/1994 Schmidt ..... 280/809
6,012,734 A * 1/2000 Skedeleski ..... 280/610
6,135,836 A * 10/2000 Rhynsburger ..... 441/74
D445,867 S * 7/2001 Reudink ..... D21/778
6,257,941 B1 * 7/2001 Rhynsburger ..... 441/79

* cited by examiner

*Primary Examiner*—S. Joseph Morano
*Assistant Examiner*—Ajay Vasudeva
(74) *Attorney, Agent, or Firm*—Dean A. Craine

(57) ABSTRACT

A protective, removable cover for a surfboard fin. The fin cover may be made of vinyl or other suitable pliable material and conforms to the shape of a standard surfboard fin with a gently rearward curved front edge and a rearward curved rear edge. Formed along the front ad rear edges of the fin cover are small indentations that compress the fi cover against the front and rear edges of the surfboard fin, respectively, to securely hold the fin cover over the fin thereby eliminating the need for adhesives or snaps.

4 Claims, 2 Drawing Sheets

SURFBOARD FIN COVER

BACKGROUND OF THE INVENTION

1. Field of the Invention

This invention pertains to covers and, more particularly, to such covers that fit snugly over surfboard fins and resist accidental disengagement.

2. Description of the Related Art

It is widely recognized that water vehicles that glide over water, such as surfboards, wakeboards, etc., have fins that extend downward into the water. Protective covers are often placed over the fins when the boards are not in use to protect them from being damaged, or to protect them from damaging other property.

Disclosed in the prior art are tip covers for such recreational boards. For example U.S. Pat. No. 6,012,734 (Skedeleski) discloses a permanently adhered, protective tip cover for a snowboard, surfboard, bodyboard, or other sport board. U.S. Pat. No. 5,310,221 (Schmidt) discloses a protective device for the tip of snow skis. U.S. Pat. No. Des. 341,643 (Schmidt) discloses an ornamental design for a protective tip cover for skis. While these covers protect the tips of the boards or skis from damage, none are specifically tailored for the fins on surfboards.

Covers for the fins of surfboards have a unique problem of not remaining on the fin when the board is carried. Because the boards are carried with their fins extended downward, covers that simply slide over the fin will fall off when the board is carried with the fins extended downward.

What is needed is a temporary, removable, pliable protective cover for the fin of a surfboard that includes features that securely attach the cover over the fin to prevent its accidental disengagement.

SUMMARY OF THE INVENTION

It is an object of the present invention to provide a protective cover for a surfboard fin.

It is another object of the present invention to provide a protective cover that is easily attachable and removable from a fin attached to a surfboard.

It is another object of the present invention to provide a protective cover that resists accidental disengagement of the cover when the surfboard is carried.

These and other objects of the invention which will become apparent are met by a protective, removable cover for a surfboard fin. The fin cover is made of vinyl or other suitable pliable material and tightly conforms to the shape of the surfboard fin. Formed along the front and rear edges of the cover are small indentations that resiliently compress against the front and rear edges of the fin to frictionally hold the cover thereon thereby eliminating the need for adhesives or straps.

DESCRIPTION OF THE PREFERRED EMBODIMENT(S)

Figure 1:
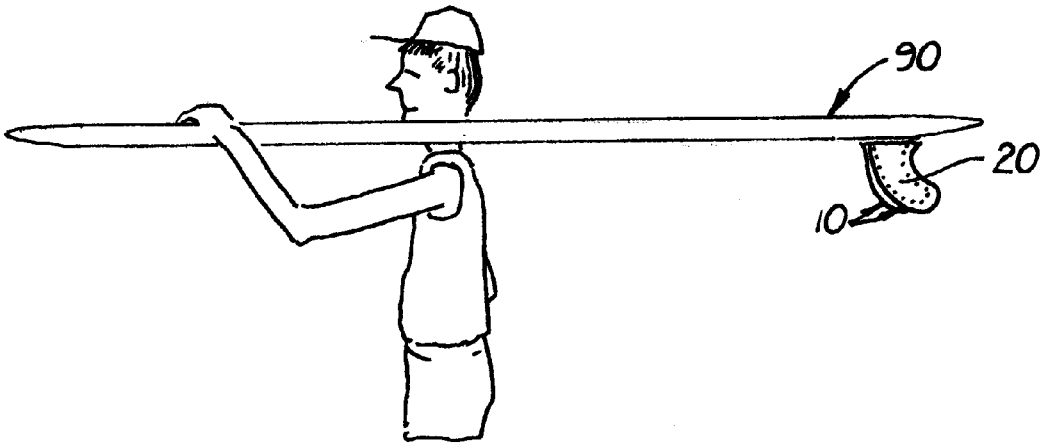
FIG. 1 is a side elevational view of a person carrying a surfboard with a cover placed over the surfboard fin.

Referring to the accompanying FIGS., there is shown and described a protective, removable cover 10 for a surfboard fin 20 attached to a surfboard 90. The cover 10 is designed to be selectively attached to the fin 20 so that it will not accidentally fall off the surfboard 90 when carried in a downward extending position as shown in FIG. 1. The fin cover 10 is made of vinyl or other suitable pliable material and snugly conforms to the shape of the surfboard fin 20. Formed along the front and rear edges 13, 14, respectively, of the cover 10 are small indentations 17, 18, respectively, that compress the inside surface of the cover 10 against the edges 13, 14 of the fin 20, to frictionally hold the cover 10 on the fin 20 without the need for adhesives.

In the preferred embodiment, the cover 10 includes a thin body 12 with a rearward curved front edge 13, a rearward curved rear edge 14, a closed, lower portion 15 and an upper opening 16. Formed on the front and rear edges 13, 14, respectively, is a plurality of indentations 17, 18. In the preferred embodiment, there are three indentations 17 evenly spaced apart and formed along the front edge 13 and at least one indentation 18 formed on the rear edge 14 near the cover's mid-line axis 19 of the cover.

Figure 2:
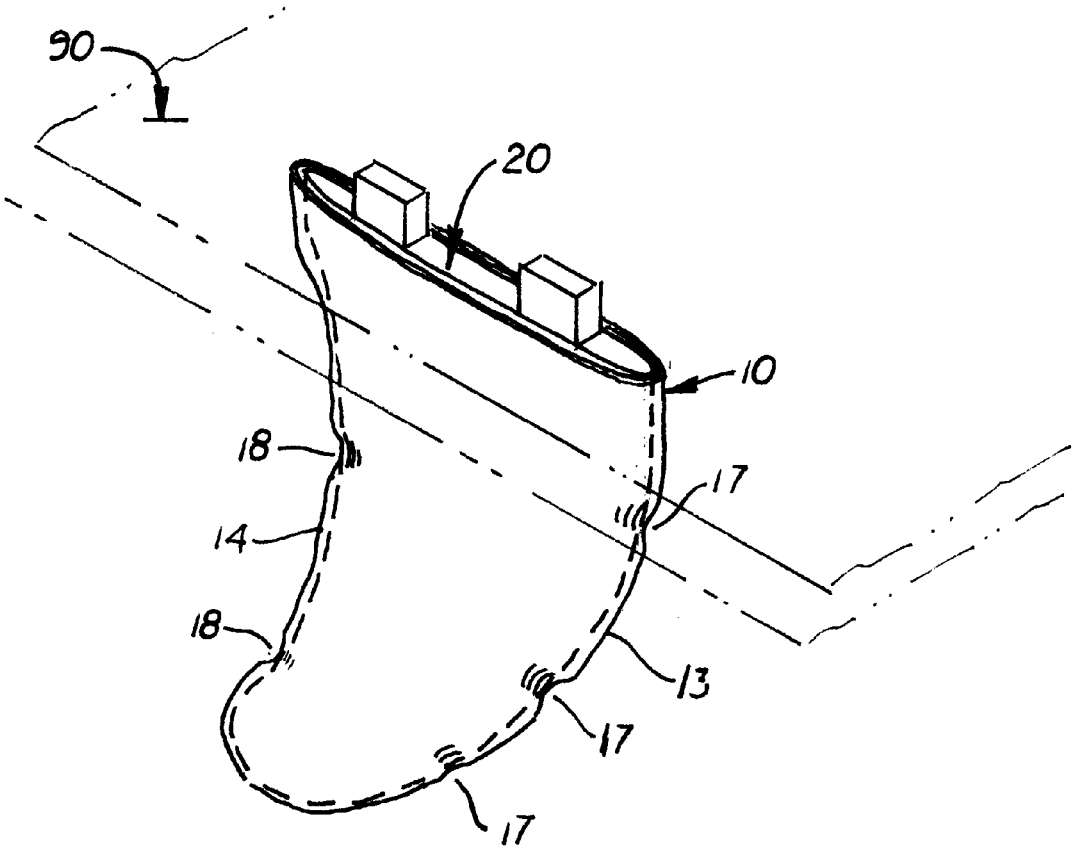
FIG. 2 is a perspective view of a surfboard fin with a cover placed over the fin.
Figure 3:
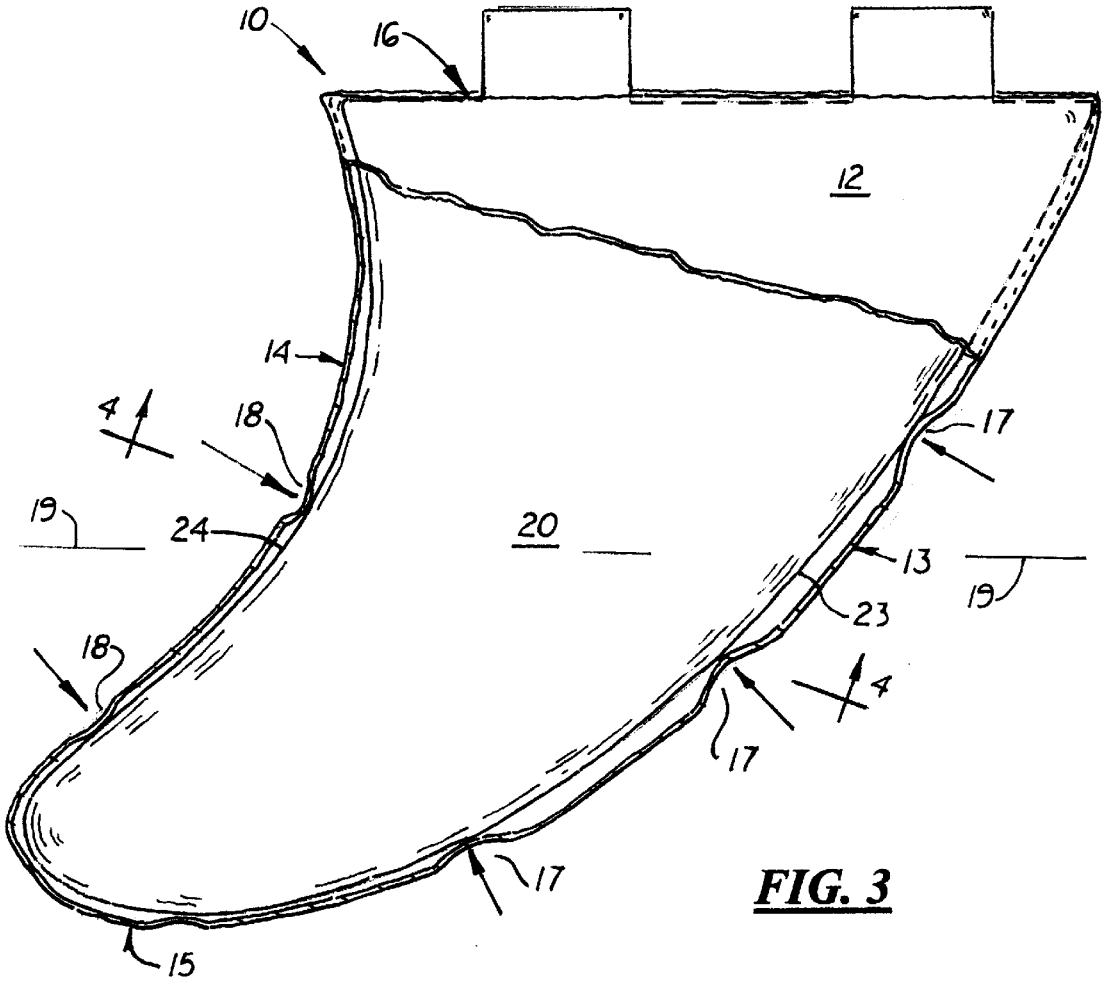
FIG. 3 is a sectional, right side elevational view of the cover placed over a surfboard fin.
Figure 4:
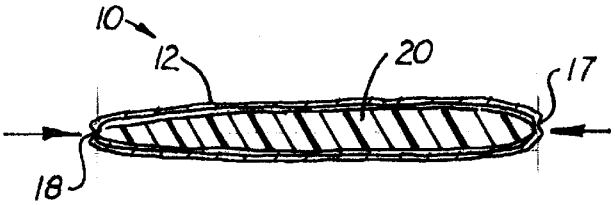
FIG. 4 is a sectional plan view of the cover taken along line 4—4 in FIG. 3.

As shown in FIGS. 2 and 3, when the cover 10 is longitudinally aligned over the fin 20 so that the fin 20 may be extended into the upper opening 16, the body 12 is forced downward so that the front and rear edges 13, 14, respectively, are placed adjacent to the front and rear edges 23, 24, respectively, on the fin 20. The indentations 17, 18 apply pressure to the edges 23, 24 from opposite sides of the fin 20 to hold the cover 10 in place.

In the preferred embodiment, the body 12 measures 4¼ inches in height, 7 inches in length, and ⅜ inch in width. The lower opening 15 is approximately 4¼ inches in length. The body 12 is made of polyvinyl chloride. The side walls of the body 12 are approximately 0.07 inch in thickness and have a hardness of Shore 70 + or − 5. The indentations 17, 18 are approximately ½ inch in length and approximately ⅛ inch in depth.

In compliance with the statute, the invention disclosed herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A protective surfboard fin cover, comprising:

a. a thin body for covering a surfboard fin, said body having a rearward curved front edge, a rearward curved rear edge, and a main opening enabling said body to be placed longitudinally over the surfboard fin, said body being made of pliable material so that said body conforms to the shape of the surfboard fin when attached thereto; and, b. at least one indentation formed on said front edge and, at least one indentation formed on said rear edge of said body, both said indentations having a sufficient depth so that said front and rear edges compress against front and rear edges of the fin to secure said body thereon.

2. A protective surfboard fin cover, as recited in claim 1, wherein there are at least two indentations formed on said front edge of said body.

3. A protective surfboard fin cover, as recited in claim 2, wherein there are at least two indentations on said rear edge of said body.

4. A protective surfboard fin cover, as recited in claim 1, wherein said body is made of polyvinyl chloride with a hardness of Shore 70.

* * * * *

UNITED STATES PATENT AND TRADEMARK OFFICE

CERTIFICATE OF CORRECTION

PATENT NO. : 6,394,865 B1
DATED : May 28, 2002
INVENTOR(S) : Robert Anthony Arzadon It is certified that error appears in the above-identified patent and that said Letters Patent is hereby corrected as shown below:

Title page,
Item [57], ABSTRACT,
Line 5, replace “ad” with -- and --.
Line 6, replace “fi” with -- fin --.

Column 2,
Line 4, replace “position as shown” with -- position, as shown --.
Line 8, replace “17, 18, respectively,” with -- 17, 18 formed thereon, respectively, --.
Line 19, replace “near the cover’s mid-line axis 19 of the cover.” with
-- near the mid-line axis 19 of the cover 10. --
Line 27, replace “4-1/4” with -- 4-1/2 --
Line 28, replace “3/6” with -- 3/16 --.

Signed and Sealed this

Twenty-seventh Day of January, 2004

JON W. DUDAS
*Acting Director of the United States Patent and Trademark Office*